United States Patent [19]

Park

[11] Patent Number: 4,814,758

[45] Date of Patent: Mar. 21, 1989

[54] COLOR PLASMA DISPLAY PANEL MAKING USE OF A MULTIPLE SUBSTRATE

[75] Inventor: Yong S. Park, Kyungsangbook-do, Rep. of Korea

[73] Assignee: Goldstar Co., Ltd., Seoul, Rep. of Korea

[21] Appl. No.: 139,598

[22] Filed: Dec. 30, 1987

[30] Foreign Application Priority Data

Dec. 30, 1986 [KR] Rep. of Korea ..... 11592/1986

[51] Int. Cl.[4] ..... G09G 3/28

[52] U.S. Cl. ..... 340/771; 340/773; 340/703; 340/772; 315/169.4; 313/582

[58] Field of Search ..... 340/771, 773, 774, 775, 340/781, 772, 701, 703; 315/169.4; 313/582, 585

[56] References Cited

U.S. PATENT DOCUMENTS 4,486,749 12/1984 Kishino et al. ..... 340/775
4,513,281 4/1985 Ngo ..... 340/772
4,540,983 9/1985 Murimoto ..... 340/775
4,689,617 8/1987 Costa et al. ..... 340/771
4,734,623 3/1988 Ohkoshi et al. ..... 315/169.4

*Primary Examiner*—Gerald L. Brigance
*Attorney, Agent, or Firm*—Birch, Stewart, Kolasch & Birch

[57] ABSTRACT

A color plasma display panel making use of a multiple layer substrate includes a glass plate arranged with an inverse frusto-conical discharge space, an anode formed on the upper surface of the glass plate in the inner central part of the discharge space, a thin glass plate provided with a circular hole through which the discharge space extends in its position on the glass plate, three cathodes formed annularly in the inner surface of the thin glass plate at a regular angle with the anode as the center, an insulation substrate provided with a circular hole through which the discharge space extends on the thin glass plate and a front glass substrate arranged on said insulation substrate so that a R, G, B fluorescent substance may be formed at the bottom to confront with the three cathodes.

1 Claim, 3 Drawing Sheets

COLOR PLASMA DISPLAY PANEL MAKING USE OF A MULTIPLE SUBSTRATE

BACKGROUND OF THE INVENTION

1. Field of the Invention

The present invention relates to a color plasma display panel and more particularly to a color plasma display panel which makes use of a multiple substrate aimed to raise the density of picture elements and to obtain a high resolution by arranging three cathodes annularly with a common anode as its center using a multiple layer substrate.

2. Description of the Prior Art

Referring to the prior color plasma display panel, it uses a different fluorescent substance for each picture element of several unicolor display panels which are different in discharge space and then uses it as one picture element. Consequently, the resolution of such a color plasma display panel can not help but be lower than that of such unicolor plasma display panel because several picture elements are colorized as one picture element as shown in FIGS. 1(A) and 1(B)

In order to drive such prior picture elements, electrodes must be arranged diagonally or perpendicularly, as shown in FIGS. 2(A) and 2(B) When color picture elements of $R_1$, $G_1$, $B_1$ are driven using a diagonal arrangement, the case of the $R_1$ picture element being driven, a voltage must be impressed on the $X_1$ electrode and $Y_1$ electrode, and with case of $G_1$ being driven, a voltage must be impressed on the $X_1$ and $Y_2$ electrodes, and for $B_1$ on the $X_2$ and $Y_1$ electrodes.

Such an electrode arrangement requires that $X_1$, $X_2$ electrodes and $Y_1$ $Y_2$ electrodes be combined in a complicated manner to drive color picture elements of $R_1$, $G_1$, $B_1$. However, in the case wherein the exciting energy of R, G, B fluorescent substances are different, it is impossible to arrange those electrodes in such a way. The reason for this is that a particular voltage can not be impressed to a particular fluorescent substance because both the X electrode and Y electrode contain R, G, B picture elements.

In the diagonal arrangement of electrodes as shown in FIG. 2(B) at least the Y electrode out of X and Y electrodes has the R, G, B fluorescent substances arranged on $Y_1$, $Y_2$, $Y_3$ electrodes in a regular order and so a differential voltage can be applied. Specifically, the voltage required to excite R, G, B fluorescent substances can be applied differently to $Y_1$, $Y_2$, $Y_3$ electrodes. In such an electrode arrangement method, however, there is a disadvantage in that the three colors of R, G, B are not mixed effectively as compared with the method shown in FIG. 2(B) because picture elements of R, G, B are arranged in a single file.

SUMMARY OF THE INVENTION

Therefore, the object of the present invention is to provide a color plasma display panel, to simplify the configuration of the driving circuit and to achieve an effective mixture of three colors R, G, B by making up for such defects as described hereinabove.

The object of the present invention can be attained if and when common anodes and three cathodes are made to discharge within the same discharge space by arranging three cathodes annularly at a regular angle with one anode at the center using a multiple layer substrate where an approximately inverse frusto-conical space is formed and resolution is improved by an effective mixture of the three colors R, G, B and, at the same time, the number of electrodes is reduced to the minimum by using one anode for three cathodes.

These and other objects, features and advantages of the present invention will become more apparent from the following detailed description taken in conjunction with the accompanying drawings.

DETAILED DESCRIPTION OF THE INVENTION

Figure 1:
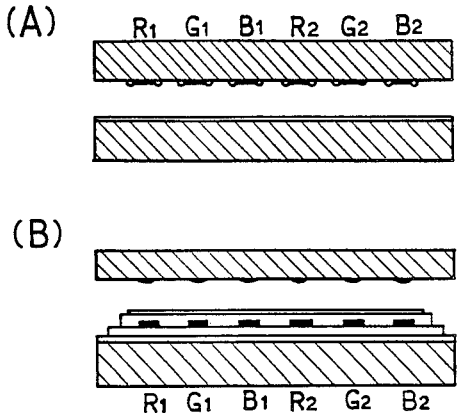
FIG. 1 PRIOR ART
FIGS. 1(A) and 1(B) are sectional views of prior color plasma display panel.
Figure 2:
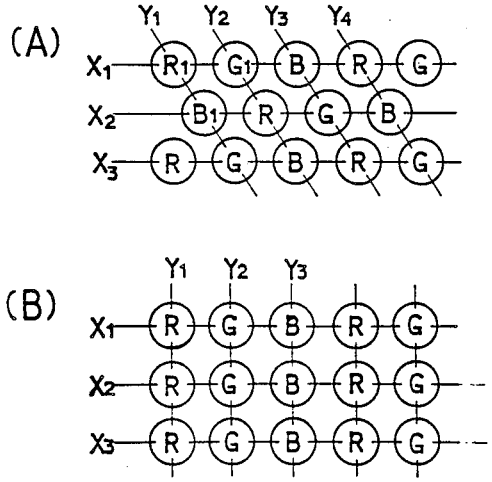
FIG. 2 PRIOR ART
FIGS. 2(A) and 2(B) are diagrams showing the arrangement of electrodes used for the prior color plasma display panel.
Figure 3:
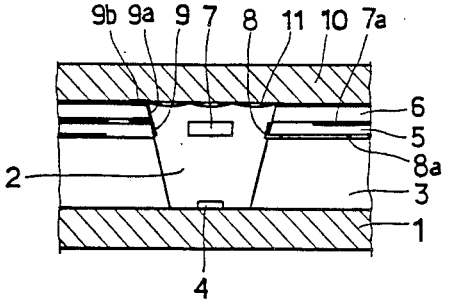
FIG. 3 is a cross-sectional view of a color plasma display panel made avaiable under the present invention.
Figure 4:
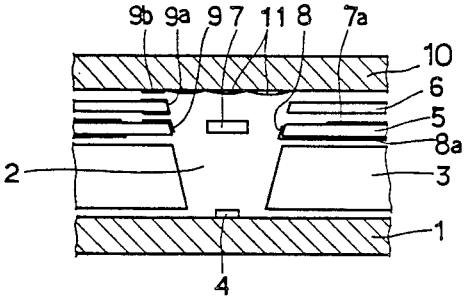
FIG. 4 is a cross-sectional view of the disassembled color plasma display panel of FIG. 3.
Figure 5:
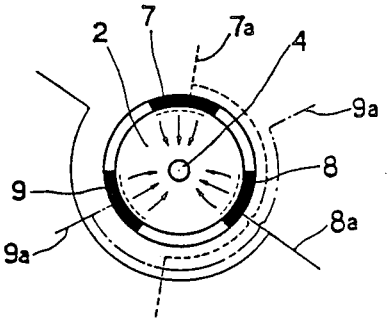
FIG. 5 is a plan view showing the state where one part is selected to illustrate the arrangement of electrodes according to the present invention.

Given an explanation of one embodiment devised under the present invention with reference to the drawings attached hereto, it comes as follows:

FIG. 3 and FIG. 4 are a cross-sectional view and a disaseembled cross-sectional view showing the configuration of the color plasma display panel of the present invention. As illustrated, a glass plate 3 provided with an approximately inverse frusto-conical discharge space 2 by piercing the upper and lower parts is arranged on the rear substrate 1 and an anode 4 is arranged on the rear substrate 1 in the central side at the bottom of the discharge space 2. On the upper part of the glass plate 3, a thin glass plate 5 wherein a circular hole is formed in order that the discharge space 2 may extend continuously is arranged. In the inner surface of the thin glass plate 5 facing the side of discharge space 2, the three cathodes 7, 8, 9 arrayed at a mutually equal angle are arranged as shown in FIG. 5. On the two cathodes 7, 8, the two electric conductors 7*a*, 8*a* are respectively arranged. On the upper side of the thin glass plate 5, an insulation substrate 6 provided with a circular hole so as to extend the discharge space 2 is placed, and this constitutes one multiple layer substrate together with the glass plate 3 and thin glass plate 5. Also, a conductive film 9*a* is formed in a part of the inner circumferential surface of hole in the insulation substrate 6 connected with the discharge space 2 and it connects an electric conductor 9*b* and a cathode 9 which are formed in the bottom of the front glass substrate 10 disposed on the upper part of the insulation substrate 6. And in the bottom of the front glass substrate 10, R, G, B, picture elements 11 are formed facing the discharge space 2, and they confront with those cathode electrodes 7, 8, 9 respectively.

The color plasma display panel constituted in such a manner can be made to apply differentially a proper electric potential which excites the R, G, B fluorescent substances 11 to the respective cathodes 7, 8, 9 as the three cathodes 7, 8, 9 are arranged concentrically with an anode 4 within the same discharge space 2 and can be made to confront with those R, G, B formed in the bottom of the front glass substrate 10 as shown in FIG. 5. When the voltage is impressed on the cathodes 7, 8, 9 and anode 4, an electric field starts from those cathodes 7, 8, 9 and concentrates in the anode 4. Then, it presents a negative glow phenomenon in the range (indicated by a dotted line) adjacent to those cathodes 7, 8, 9 as shown in a dotted line in FIG. 5 and obtains various colors by exciting the fluorescent substance 11 formed in the bottom of the front glass substrate 10 with ultraviolet rays generated in the negative glow range. Also, as the discharge space 2 is used in common, a high resolution is obtainable by a rise in electrode density and, as the distance between cathodes 7, 8, 9 and fluorescent substance 11 is equal, the mixture of three R, G, B colors can be effected smoothly.

Figure 6:
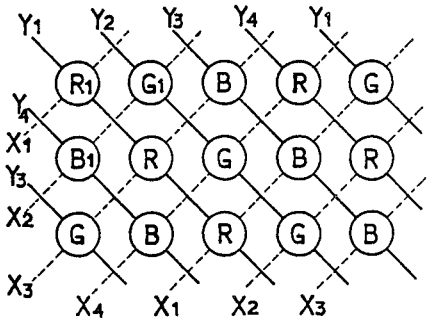
FIG. 6 is a diagrammatic view illustrating the arrangement of electrodes according to the present invention.

On the other hand, FIG. 6 illustrates an example of the electrode arrangement of the present invention. In the case of the $R_1$ picture element being driven, the voltage must be impressed on the $X_1$ and $Y_1$ electrodes, in the case of $G_1$ picture element being driven, the voltage must be impressed on the $X_2$ and $Y_2$ electrodes, and in the case of $B_1$ picture elements being driven, the voltage must be impressed the on $X_2$ and $X_4$ electrodes. In the case of the electrode arrangement of the present invention, however, the picture elements connected with $Y_1$, $Y_2$, $Y_3$ . . . electrodes are only R, G, B elements arranged in a single file and so a Y electrode can be impressed by different voltage differentially, thereby enabling the mixture ratio of three R, G, B colors to be adjusted freely.

Figure 7:
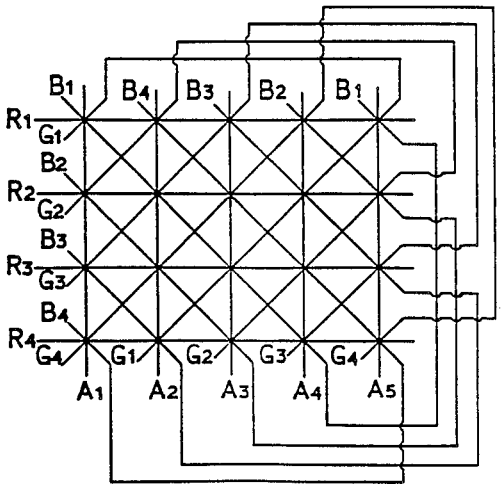
FIG. 7 is a diagrammatic view showing that the cathodes are connected to minimize the number thereof according to the present invention.

FIG. 7 illustrates the electrode arrangement made to simplify the driving circuit by minimizing the number of electrodes according to the present invention. It shows that R, G, B elements are connected with one anode ($A_1$, $A_2$ . . . ) in common.

As R, G, B elements confront with those cathodes 7, 8, 9 respectively, one anode 2 holds three cathodes 7, 8, 9 in common. So, the driving circuit of the present invention is much simpler than the prior system in which one anode requires one cathode.

As described hereinabove, the color plasma display panel of the present invention provides a means whereby the resolution of display panel can be improved and, at the same time, the driving circuit can be simplified by enabling one anode to hold three cathodes in common with a use of multiple layer substrate provided with a common discharge space.

What is claimed is:

1. A color plasma display panel making use of a multiple layer substrate, which comprises:

a rear substrate, a glass plate arranged with an inverse frusto-conical discharge space in its position on said rear substrate, an anode formed on the upper surface of said glass plate in the inner central part of said discharge space, a thin glass plate arranged with a circular hole through which said discharge space extends in its position on said glass plate, three cathodes formed annularly in the inner surface of said thin glass plate at a regular angle with said anode as the center, an insulation substrate arranged with a circular hole through which said discharge space extends on said thin glass plate, and a front glass substrate arranged on said insulation substrate so that a R, G, B fluorescent substance may be formed at the bottom to confront said three cathodes.

* * * * *